United States Patent [19]

Obinata et al.

[11] 4,349,330

[45] Sep. 14, 1982

[54] COMBUSTION CONTROL DEVICE FOR NOZZLE SPRAY TYPE BURNER

[75] Inventors: Akio Obinata; Satoshi Ohsawa, both of Suzaka, Japan

[73] Assignee: Orion Machinery Co., Ltd., Nagano, Japan

[21] Appl. No.: 109,268

[22] Filed: Jan. 3, 1980

[30] Foreign Application Priority Data

May 2, 1979 [JP] Japan ..... 54-54424

[51] Int. Cl.[3] ..... F23Q 9/08; F23N 3/00

[52] U.S. Cl. ..... 431/60; 431/90

[58] Field of Search ..... 431/90, 56, 58, 59, 431/60, 62, 162, 12; 126/110 E, 116 A, 112; 137/554; 110/187

[56] References Cited

U.S. PATENT DOCUMENTS

| | | | |
|---|---|---|---|
| 2,315,412 | 3/1943 | Galumbeck | 431/60 |
| 3,070,149 | 12/1962 | Irwin | 431/60 X |
| 3,164,201 | 1/1965 | Irwin | 431/90 X |
| 3,285,315 | 11/1966 | Voorheis | 431/60 |
| 3,797,989 | 3/1974 | Gordon | 431/90 |
| 3,814,570 | 6/1974 | Guigues et al. | 431/90 X |
| 4,203,720 | 5/1980 | Chaffee et al. | 431/90 X |

*Primary Examiner*—Samuel Scott
*Assistant Examiner*—Randall L. Green
*Attorney, Agent, or Firm*—Toren, McGeady & Stanger

[57] ABSTRACT

An improved nozzle spray type burner including a combustion chamber, a housing having an exhaust passage coupled to the combustion chamber, a fan mounted in the housing for directing air through the exhaust passage to the combustion chamber and a fuel spray nozzle in the exhaust passage for spraying fuel into the flow of air in the exhaust passage. The improvement includes a first mechanism associated with the fan to control the flow rate of air in the exhaust passage, and a second mechanism associated with the nozzle for controlling the amount of fuel sprayed from the nozzle. The first and second mechanisms are arranged to cooperate to control the degree of combustion of the fuel with the air in the combustion chamber.

5 Claims, 6 Drawing Figures

COMBUSTION CONTROL DEVICE FOR NOZZLE SPRAY TYPE BURNER

BACKGROUND OF THE INVENTION

The present invention relates generally to combustion control devices and particularly to a device for regulating the combustion of a nozzle spray type burner which is used as a heat source for an infrared ray heating device.

Conventional infrared ray emission or heating devices are constructed, for example, as shown in FIG. 1. A burner body or housing 1 encloses a fan 2, and forms an intake passage 3 and an exhaust passage 4 for directing combustion air to and away from the fan. A fuel spray nozzle 5 is provided in the region of the outlet of the exhaust passage 4. A fuel pump 6 feeds liquid fuel such as kerosene to the nozzle 5, and a discharge electrode 7 spaced from the nozzle 5 forms a predetermined discharge gap between the electrode 7 and the nozzle 5 for ignition purposes.

A butterfly valve 8 is provided in the intake passage 3 for controlling the combustion air. More particularly, valve 8 controls the rate of flow of the air for combustion which is fed into a combustion chamber 10 associated with an infrared ray heating device 9, the device 9 being coupled to the outlet of the exhaust passage 4. An insulating material 11 forms a part of the combustion chamber 10, and a heat generating member 12 forming a wall of the combustion chamber 10 provides a heat generating or emitting surface associated with the infrared ray heating device 9.

In the conventional heating device constructed as above, the fan 2 operates to send air for combustion purposes into the combustion chamber 10, while the fuel pump 6 operates to supply liquid fuel which is sprayed into the air flow through the nozzle 5 for combustion within the combustion chamber 10. As the heat generating member 12 is heated to a red heat condition, infrared rays are emitted therefrom. The combustion within the burner may be regulated to vary the amount of infrared ray emission. However, in the prior art heaters, the fuel supply system and the air supply system were constructed independently of each other, therefore making it extremely difficult to change the degree of combustion.

According to the prior art, the butterfly valve 8 was fixed in such a way as to assure a flow of air in an amount corresponding to the amount of the fuel sprayed through the fuel spray nozzle 5, thereby preventing the combustion flames from extinguishing or producing soot.

Accordingly, a so-called ON-OFF type of control provided by a thermostat or manual operation was relied upon in order to regulate the room temperature, since it was virtually impossible to control the infrared ray emission, or the heat generated by the burner.

However, the conventional heaters had the disadvantage that when this ON-OFF type of control occurred, the balance between the air and the fuel was quite easily disturbed upon ignition of the air-fuel mixture or extinguishing the combustion flame, thereby resulting in the creation of soot, or even the generation of foul odors. Also, differences in room temperature between the times the combustion flame was present or extinguished became unduly large.

An object of the present invention is to overcome the above defects of the prior art.

Another object of the present invention is to provide a combustion control device for a nozzle spray type burner wherein the flow rate of combustion air and the amount of fuel sprayed into the combustion chamber are simultaneously controlled, a first mechanism of the device which controls the flow rate of the combustion of air being interconnected with a second mechanism of the device which controls the amount of fuel sprayed into the combustion chamber.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
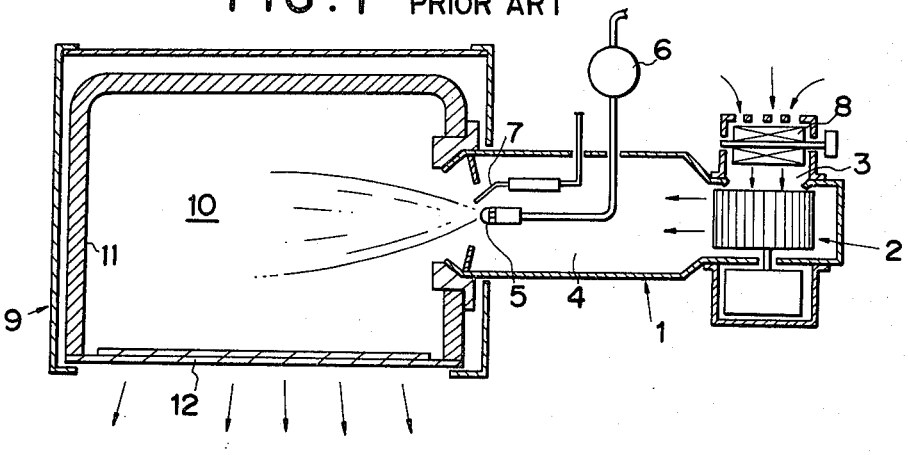
FIG. 1 PRIOR ART
FIG. 1 is a top plan view, partly in section, of a prior art infrared heating device including a fuel burner for directing heat to a region in front of the device.
Figure 2:
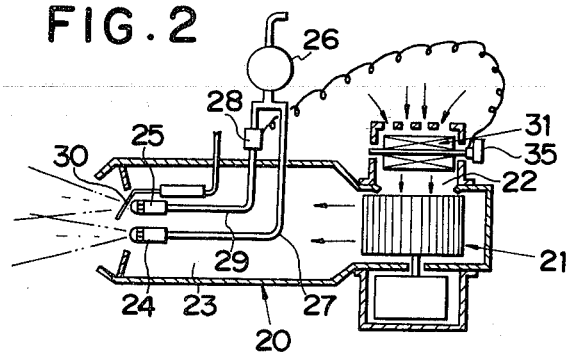
FIG. 2 is a top plan view, partly in section, of a combustion control device arranged in the burner of the heating device of FIG. 1, according to the present invention.
Figure 3:
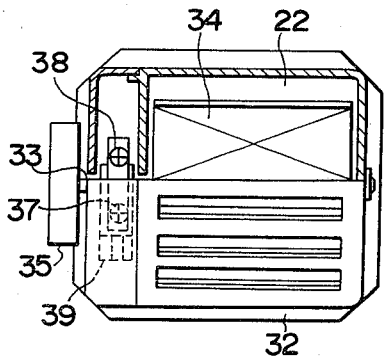
FIG. 3 is an enlarged, elevational view, partly in section, of an air exhaust adjustment mechanism in the device of FIG. 2.
Figure 4:
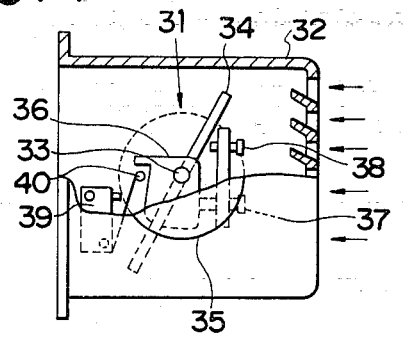
FIG. 4 is a side view, partly in section, of the mechanism of FIG. 3.

FIGS. 2–4 show a first embodiment of a combustion control device according to the present invention, including a burner body or housing 20 which encloses a fan 21 and forms a suction or intake passage 22 and an exhaust passage 23 for directing combustion air to and away from the fan 21. A main nozzle 24 and an auxiliary nozzle 25 are provided in the exhaust passage 23 adjacent its outlet. A fuel pump 26 is directly connected to the main nozzle 24 by way of a fuel pipe 27. Fuel pump 26 is connected to auxiliary nozzle 25 by fuel pipe 29 and an electromagnetic ON-OFF type switch valve 28 which acts as a control mechanism for the amount of fuel sprayed from the auxiliary nozzle 25. A discharge electrode 30 which is connected to a high voltage generating device (not shown) forms predetermined discharge gaps between the electrode 30 and the nozzles 24,25 for purposes of ignition.

A butterfly valve 31 acts as a control mechanism for the air entering the intake passage 22. The valve 31 includes a valve plate 34 which is fixed to a valve shaft 33 for rotation about the axis of the shaft 33, the latter being axially supported within a casing 32 which forms the intake passage 22 and part of the burner housing 20.

A control knob 35 is fixed to one end of the shaft 33, and can be turned from outside the casing 32 to operatively rotate the valve plate 34 by way of the valve shaft 33. This operation controls the draft resistance in the intake passage 22 to regulate the flow rate of the combustion air provided by fan 21 in the exhaust passage 23. A cam 36 (FIG. 4) fixed to the valve shaft 33 operates as a stopper for the butterfly valve 31. Adjusting screws 37,38 can be set to abut against the cam 36 and define the maximum and minimum opening positions of the butterfly valve 31 within the intake passage 22, thereby controlling the maximum and minimum flow rates of combustion air. A control switch 39 for the electromagnetic switch valve 28 is mounted within the casing 32.

Switch 39 has a movable part 40 which actuates the switch 39 and which is located opposite the cam face of the cam 36. When the butterfly valve 31 is held in a position corresponding to a minimum opening, as shown in FIG. 4, the section of the fuel pipe 29 connected between the auxiliary nozzle 25 and the fuel pump 26 is shut off since the electromagnetic switch valve 28 is in an off condition. When the butterfly valve 31 is in a position corresponding to a maximum opening, the electromagnetic switch valve 28 is turned on by way of a control switch 39 thereby connecting the auxiliary nozzle 25 and the fuel pump 26.

In accordance with the above construction, when a drive switch (not shown) is turned on, the fan 21 and the fuel pump 26 are both started. The fan 21 then provides air which has passed from outside the device into the intake passage 22 to the exhaust passage 23 for combustion. If the cam 36 of the butterfly valve 31 is at the minimum opening position abutting against the adjustment screw 37 as shown in FIG. 4, the vent resistance at the intake passage 22 is at a maximum amount, and a relatively small quantity of combustion air is provided into the exhaust passage 23.

With the butterfly valve 31 held at the minimum opening position as described above, control switch 39 is turned OFF. Accordingly, the auxiliary nozzle 25 and the fuel pump 26 do not communicate with each other and fuel is sprayed into the flow of combustion air in the exhaust passage 23 from only the main nozzle 24. In this case, the relative amounts of fuel and air are adjusted within a stable combustion range wherein no flame extinguishment or soot occurs. Specifically, when the drive switch is initially turned ON, high voltage is intermittently applied on the discharge electrode 30, and a discharge spark is formed between the electrode 30 and the main nozzle 24, thus igniting the fuel sprayed from the main nozzle 24 to start combustion. After combustion starts, the discharge electrode 30, or a flame detecting electrode (not shown) is used to detect the flame and stop operation of the high voltage generating or ignition device. Further, after combustion starts, a part of the combustion energy rapidly vaporizes the fuel thereby ensuring continuous stable combustion.

If the control knob 35 is then turned to bring the butterfly valve 31 to the maximum opening position, the vent resistance in the intake passage 22 is decreased. The intake efficiency of the fan 21 is accordingly improved, and the air flow rate provided in the exhaust passage 23 is increased. When the butterfly valve 31 is at the maximum opening position, the control switch 39 is turned ON by way of the cam 36, thereby actuating the electromagnetic switch valve 28. As a result, fuel flows to the auxiliary nozzle 25 from the fuel pump 26 in an amount corresponding to the increase in the flow rate of the combustion air.

In other words, by simply operating the control knob 35 in a one touch operation, the flow rate of the combustion air is adjusted quickly and the amount of fuel sprayed or injected for combustion with the air is correspondingly adjusted, as well. Thus, it is possible to vary the degree of combustion of the burner while maintaining a stable combustion condition.

The embodiment of FIGS. 2–4 provides a two step change of the degree of combustion in the burner. Multiple-step changes are also possible.

Figure 5:
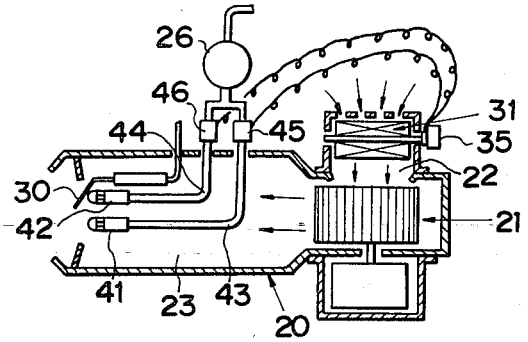
FIG. 5 is a top sectional view, similar to FIG. 2, of a second embodiment of a combustion control device according to the present invention.

A second embodiment shown in FIG. 5 provides for a three-step change in the degree of burner combustion. The burner includes two nozzles 41,42 in the vicinity of the outlet of the exhaust passage 23, the nozzles 41,42 having different spray capacities. ON-OFF type electromagnetic switch valves 45,46 are provided in fuel pipes 43 and 44 which connect the nozzles 41,42 with the fuel pump 26.

According to the embodiment of FIG. 5, the amount of fuel sprayed at the outlet of the exhaust passage 23 can be controlled in three steps by suitably controlling the electromagnetic switch valves 45,46. In this case, the butterfly valve 31 is constructed with a switch mechanism (not shown) which actuates the electromagnetic switch valves 45,46 in accordance with the degree to which the butterfly valve 31 is opened, the amount of air provided in the exhaust passage 23 being appropriately matched with the amount of fuel sprayed from one or both of the nozzles 41,42.

Figure 6:
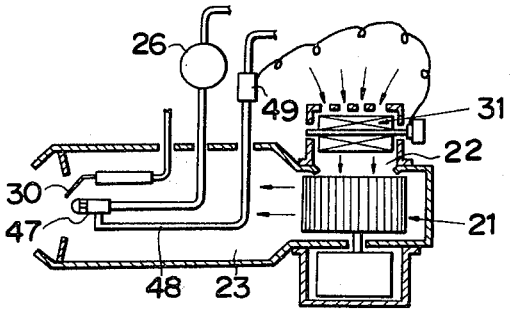
FIG. 6 is a top sectional view, similar to FIGS. 2 and 5, of a third embodiment of a combustion control device according to the present invention.

FIG. 6 shows a third embodiment of the present invention wherein the degree of combustion is not changed in a stepwise manner. An electromagnetically operated throttle valve 49 is provided on a fuel return pipe 48 which extends from a nozzle 47 in the exhaust passage 23 to an outside fuel tank (not shown). The throttle valve 49 is opened or closed in an inverse relation to the opening or closing of the butterfly valve 31 in the intake passage 22. As the opening of the butterfly valve 31 becomes greater, thereby increasing the flow rate of air in the exhaust passage 23, the amount of fuel returned to the fuel tank decreases. The amount of fuel sprayed into the exhaust passage thereby increases, and the degree of combustion is correspondingly increased. If it is desired to control the combustion in a step-wise manner, a switch valve can be provided in place of the throttle or regulator valve 49.

The mechanisms which adjust the amount of air provided in the exhaust passage 23 in the above-described embodiments have been simplified by providing the mechanisms with a butterfly valve 31. However, other air flow adjustment means may be employed.

Also, as described above, the fuel spray adjustment mechanisms are simplified by the provision of an electromagnetic valve. It will be understood, however, that the present invention is not to be limited to these particular mechanisms, and that automatic control mechanisms including thermostats and the like can be used in place of manually operated mechanisms.

The combustion control device of the present invention is of relatively simple construction wherein a movable part of the air adjustment mechanism which controls the flow rate of combustion air is connected with movable parts of the mechanism which adjust the amount of fuel sprayed in the air passage. Nevertheless, with the present invention, it is possible to change quickly and easily the degree of combustion of a nozzle spray type burner while continuing to operate the fan and fuel pump as in the prior burners. Accordingly, if a burner using the present adjustment device is employed as a heat source for an infrared heating device, the conventional ON-OFF control for turning heat on and off will be eliminated. It will then become possible to provide control of a HIGH-LOW or HIGH-LOW-OFF heating system by varying the degree of combustion and decreasing the frequency of ignition and flame extinction which was required in the prior art. Temperature differences and foul odors caused by the frequent ignitions and flame extinction are likewise minimized.

While specific embodiments of the invention have been shown and described in detail to illustrate the application of the inventive principles, it will be understood that the invention may be embodied otherwise without departing from such principles.

What is claimed is:

1. In a nozzle spray type of burner including a fuel source, a combustion chamber, a housing having an air passage therein coupled to said combustion chamber, a fan mounted in said housing for directing air through said air passage to said combustion chamber, fuel spray nozzle means in said air passage for spraying fuel provided by said fuel source into the flow of air in said air passage and including two fuel passageways for conducting the fuel between said fuel source and said fuel spray nozzle means, the improvement comprising a first mechanism associated with said fan for controlling the flow rate of the air in said air passage, said first mechanism comprising a butterfly valve mounted within said housing for movement over a certain path for regulating the flow of air into said air passage from outside said housing, a cam mounted for movement with said butterfly valve and a control switch arranged to be actuated by said cam when said butterfly valve is moved over a portion of the path of movement of said butterfly valve; and a second mechanism associated with said fuel spray nozzle means for controlling the amount of fuel sprayed into the flow of air in said air passage, said second mechanism including a switch valve arranged in at least one of said two fuel passageways and coupled to said control switch for controlling the flow of fuel in said fuel passageway in response to actuation of said control switch wherein the state of said first mechanism is detected by said second mechanism to control the degree of combustion of the fuel with the air in said combustion chamber.

2. A nozzle spray type burner according to claim 1, wherein said combustion chamber includes a heat generating member for infrared ray emission in response to combustion in said combustion chamber.

3. A nozzle spray type burner according to claim 1, wherein said fuel spray nozzle means includes a main fuel spray nozzle, a fuel pump connected to said fuel source, a first fuel passageway for continuously directing fuel from said fuel pump to said main fuel spray nozzle, an auxiliary fuel spray nozzle and a second fuel passageway extending between said fuel pump and said auxiliary fuel spray nozzle, said switch valve being arranged in said second fuel passageway for controlling the fuel supplied to said auxiliary fuel spray nozzle.

4. A nozzle spray type burner according to claim 1, wherein said fuel spray nozzle means includes at least two fuel spray nozzles, a fuel pump, and passageways each connected between said fuel pump and one of said fuel spray nozzles, said second mechanism including a switch valve arranged in each of said passageways for controlling the fuel supplied to each of said fuel spray nozzles.

5. A nozzle spray type burner according to claim 1, wherein said fuel spray nozzle means includes a fuel spray nozzle and a return passageway connected at one end to said fuel spray nozzle for returning unsprayed fuel from said fuel spray nozzle to an outside fuel source at the other end of said return passageway, said second mechanism including a switch valve arranged in said return passageway for controlling the amount of unsprayed fuel returned from said fuel spray nozzle to the outside fuel source.

* * * * *